US006184743B1

(12) United States Patent
Swart

(10) Patent No.: US 6,184,743 B1
(45) Date of Patent: Feb. 6, 2001

(54) BANDGAP VOLTAGE REFERENCE CIRCUIT WITHOUT BIPOLAR TRANSISTORS

(75) Inventor: David Peter Swart, Pine Island, MN (US)

(73) Assignee: International Business Machines Corporation, Armonk, NY (US)

( * ) Notice: Under 35 U.S.C. 154(b), the term of this patent shall be extended for 0 days.

(21) Appl. No.: 09/190,718

(22) Filed: Nov. 12, 1998

(51) Int. Cl.[7] ..... G05F 1/10; G05F 3/02
(52) U.S. Cl. ..... 327/538; 323/313
(58) Field of Search ..... 329/538, 539, 329/540; 323/313, 314, 315

(56) References Cited

U.S. PATENT DOCUMENTS 5,521,489 * 5/1996 Fukami ..... 323/313
5,808,507 * 9/1998 Melse et al. ..... 327/538
5,867,013 * 2/1999 Yu ..... 323/314

OTHER PUBLICATIONS

Brokaw, P., "A Simple Three—Terminal IC Bandgap Reference", *IEEE Journal of Solid–State Circuits,* vol. SC–9, No. 6, pp. 338–393 (Dec. 1974).
Taylor, "SA 21.8: A GaAs MESFET Schottky Diode Barrier Height Reference Circuit", *IEEE International Solid State Circuit Conference,* 360–361 (1997).

* cited by examiner

*Primary Examiner*—Terry D. Cunningham
*Assistant Examiner*—Quan Tra
(74) *Attorney, Agent, or Firm*—Min S. Xu; Roy W. Truelson

(57) ABSTRACT

A gallium arsenide (GaAs) bandgap circuit includes a plurality of stacked GaAs transistors being connected as Schottky diodes which, together with an amplifier, provide a constant reference voltage being independent of a power supply voltage of the circuit.

23 Claims, 5 Drawing Sheets

BANDGAP VOLTAGE REFERENCE CIRCUIT WITHOUT BIPOLAR TRANSISTORS

FIELD OF THE INVENTION

The present invention relates generally to a bandgap voltage reference circuit, and more particularly, to a bandgap voltage reference circuit used in a gallium arsenide (GaAs) based semiconductor chip.

BACKGROUND OF THE INVENTION

Generally, "bandgap" is a term used in physics and its related semiconductor technology. In physics, when the distance between two atoms approaches the equilibrium interatomic spacing of a diamond lattice, energy level splits into two bands. The two bands are separated by a region which designates energies that the electrons in a solid, such as a type of semiconductor material, cannot possess. The region is referred to a forbidden gap, or a bandgap, for this type of semiconductor material. Any change of thermal energy, electron or photon energy may affect the width of a bandgap. For example, any increase in temperature, electron or photon energy will tend to narrow a bandgap, and similarly, any decrease in temperature, electron or photon energy will tend to widen the bandgap. In addition, depending on the types of semiconductor materials, a bandgap can be wide for one type of material but narrow for another type. For example, silicon generally has a much wider bandgap than gallium arsenide (GaAs).

Many semiconductor devices, such as diodes, bipolar transistors, BiCOMs Field Effect Transistors (FETs) etc., have used bandgap characteristics of a particular semiconductor material, such as silicon. In these devices, such as a diode, a positive electrical charge can narrow the bandgap, and a negative electrical charge can widen the bandgap. In a certain operating region of a device or a circuit containing a plurality of these semiconductor devices, a bandgap can be wide enough such that a voltage at one point of the circuit is stable independent of an applied power supply. The stable voltage at that point is often used as a voltage reference, and a circuit used for designing such a stable reference voltage is often referred to as a bandgap voltage reference circuit.

In silicon bipolar, BiCOMs related technologies, a bandgap circuit employing bipolar transistors has been used to provide stable reference voltages for many years in semiconductor industry.

In recent years, gallium arsenide (GaAs) based semiconductor chips have become more and more utilized in semiconductor industry. In such GaAs chips, where bipolar transistors are not an option, it is generally difficult to design a bandgap circuit to provide a reference voltage which is independent of a power supply voltage of the circuit.

Based on the physics characteristics of the semiconductor materials described above, it is generally known that a bandgap voltage reference circuit (or in short, "a bandgap circuit") can be built from the exponential relation between the voltage and the current in an emitter junction of a bipolar transistor. It is also known that a Field Effect Transistor (FET) GaAs-based transistor exhibits a square-law relation between the voltage and the current. As a result, FET GaAs-based transistors generally do not meet requirements to build a bandgap reference circuit.

FIG. 1 illustrates a conventional bandgap circuit built from bipolar transistors Q1–Q4. The reference introducing this type of conventional bandgap circuit can be made to an article authored by A. P. Brokaw, published in IEEE Journal of Solid State Circuits, Vol. SC-9, pp. 388–393, December 1974, entitled "A Simple Three-Terminal IC Bandgap Reference". In this conventional bandgap circuit, the relation of the currents (I) and resistors (R) are as follows:

I0=I1;

I2=I3=I4;

R1=R2=R3; and

R5=R6.

In addition, an amplifier, AMP, has two inputs that are connected to nodes n1 and n2, respectively. With appropriate values of the resistors, the amplifier, and the bipolar transistors, the bandgap circuit makes use of the fixed voltage difference between the base and the emitter of the bipolar transistors, which operate at different current densities, to produce a stable output voltage Vout at node n0, i.e. the bandgap circuit output Vout or Vn0 is independent of a power supply voltage Vdd of the amplifier. Thus, the stable Vn0 is used as a reference voltage.

Accordingly, there is a need for a bandgap circuit built from FET GaAs-based transistors to provide a stable reference voltage which is independent of a power supply voltage of the circuit.

SUMMARY OF THE INVENTION

The present invention relates generally to a bandgap voltage reference circuit, and more particularly, to a bandgap voltage reference circuit used in a gallium arsenide (GaAs) based semiconductor chip.

The present invention provides a GaAs circuit which uses stacked FETs in which the source and drain of each FET are connected together to form a first terminal and the gate forms a second terminal (an FET configured in this manner being referred to herein as a "Schottky diode") and an amplifier in an arrangement to provide a stable voltage reference independent of a power supply voltage of the circuit.

In one embodiment of the present invention, the GaAs circuit includes a plurality of GaAs FETs arranged as Schottky diodes being connected to a plurality of resistors, wherein the GaAs circuit is arranged such that a voltage output is independent of a voltage input of the circuit.

One aspect of the present invention is that the gate of each Schottky diode, which is a metal, forms a Schottky junction with the source and the drain of the Schottky diode. The gate is the anode, and the source and the drain are tied together to form the cathode. Each Schottky diode exhibits an exponential relation between the current flowing through the Schottky diode and the voltage across the Schottky diode.

Another aspect of the present invention is that the Schottky diodes are stacked in branches which are electrically connected in parallel. In one embodiment, Schottky diodes are stacked in a first branch and a second branch. The first and second branches are electrically connected in parallel to each other between a voltage output node and ground. In the first branch, a first resistor is electrically connected between the voltage output node and a first node. In the second branch, a second resistor is electrically connected between the voltage output node and a second node. An amplifier has a first input electrically connected to the first node, a second input electrically connected to the second node, and an output electrically connected to the voltage output node. The first branch includes a plurality of sub-branches, such as four sub-branches, of Schottky diodes electrically connected in parallel between the first node and the ground. In each sub-branch, a first Schottky diode is electrically connected to the first node at one end and to a sub-first node at the other end, a second Schottky diode is electrically connected to the sub-first node at one end and to a sub-second node at the other end, and a third resistor is electrically connected to the sub-second node at one end and to the ground at the other end. In the second branch, a first Schottky diode is electrically connected to the second node at one end and to a third node at the other end, and a second Schottky diode is electrically connected to the third node at one end and to the ground at the other end.

A further aspect of the present invention is that the current in the first branch and the current in the second branch are the same, and the currents in each sub-branch are the same. Accordingly, the current in each sub-branch is one-fourth (¼) of the current in the second branch. In one embodiment, the first and second resistors have the same resistance, the Schottky diodes of each branch and sub-branch are the same, and the resistors of each sub-branch have the same resistance.

An additional aspect of the invention is that the gain of the amplifier and the values of the Schottky diodes and the resistors can be selected such that the voltage output is stable.

One advantage of the present invention is that it provides a stable reference voltage in a GaAs-based semiconductor chip. Another advantage of the present invention is that the values of the circuit elements can be selected to provide different stable reference voltages to meet different voltage needs. The stable reference voltages are independent of the input voltage of the circuit, such as the power supply voltage of the amplifier.

The solution proposed by the present invention can be used in many industries, such as telecommunication industry, etc. For example, the present invention can be used by makers of Radio Frequency (RF) wireless systems, cell phones, or chips for optical link systems which use GaAs chips.

These and other features and advantages of the present invention will become readily apparent to those skilled in the art from the following detailed description and corresponding drawings. As will be realized, the invention is capable of modification without departing from the invention. Accordingly, the drawing and description are to be regarded as illustrative in nature, and not as restrictive.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

The present invention relates generally to a bandgap voltage reference circuit, and more particularly, to a bandgap voltage reference circuit used in a gallium arsenide (GaAs) based semiconductor chip.

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

Figure 1:
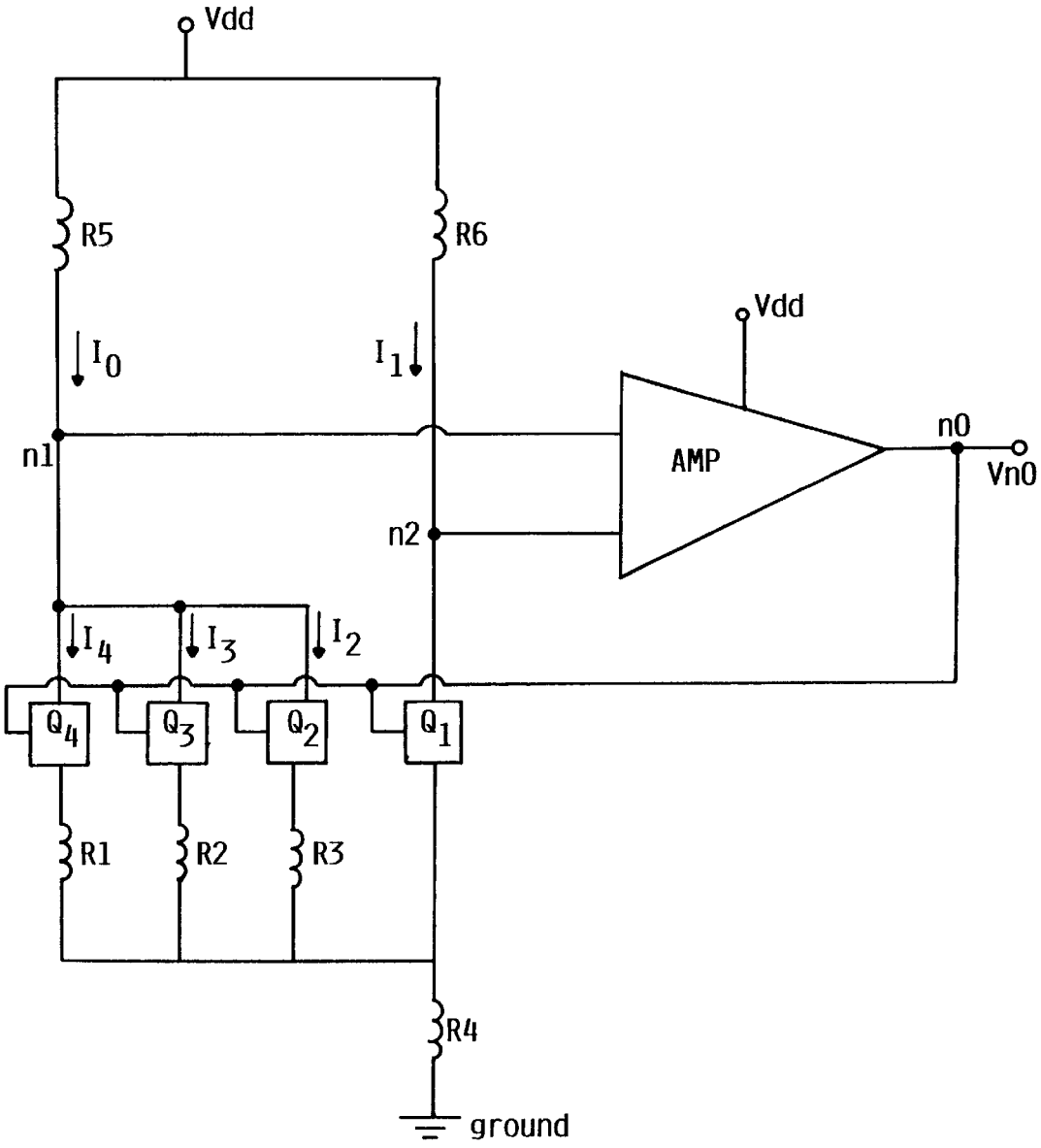
FIG. 1 (PRIOR ART)
FIG. 1 is a circuit diagram of a conventional bandgap circuit built from bipolar transistors.
Figure 2:
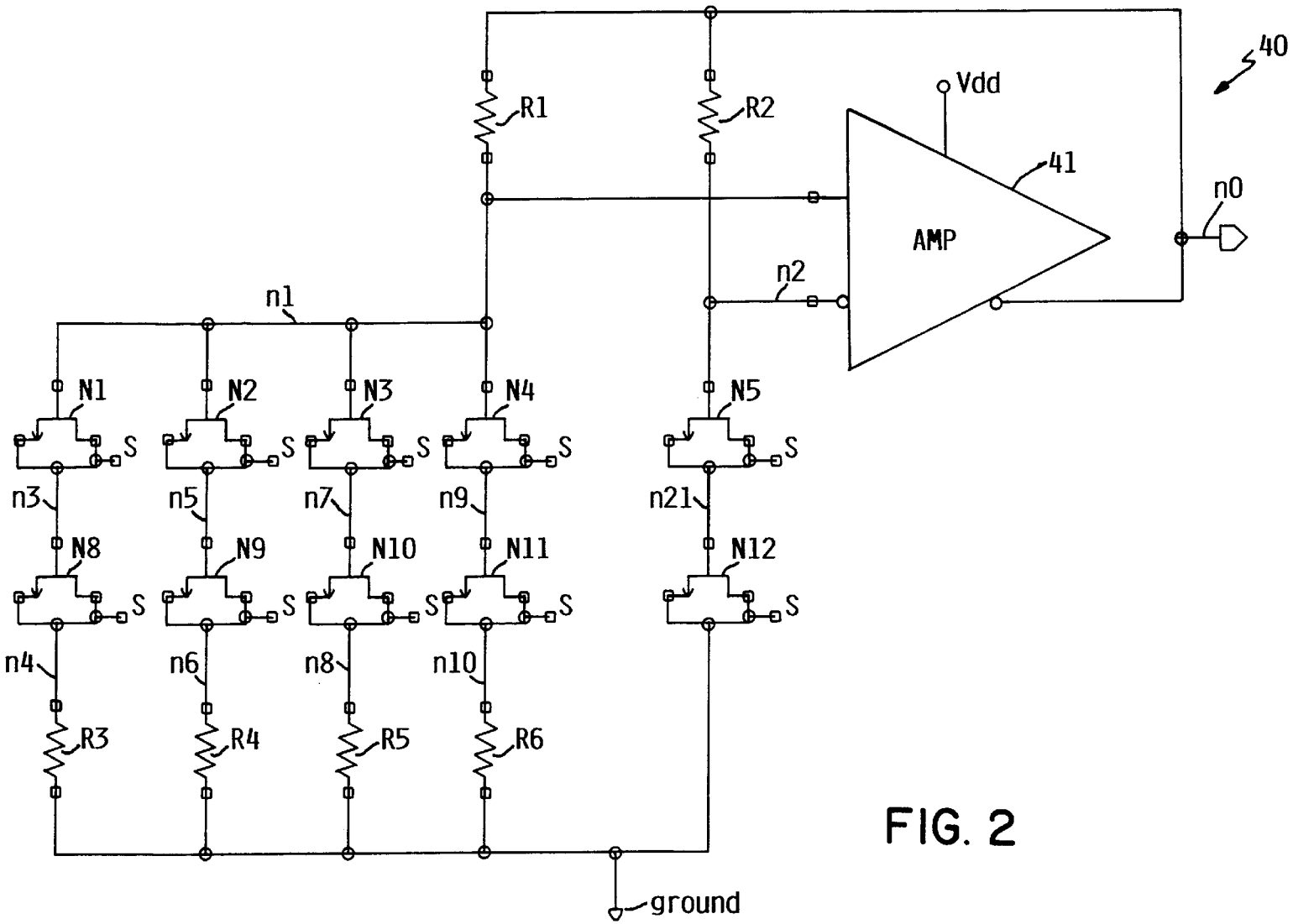
FIG. 2 is a circuit diagram of a bandgap circuit built from FET gallium arsenide (GaAs) transistors in accordance with the present invention.

Referring to FIG. 2, a gallium arsenide (GaAs) bandgap circuit 40 is shown. An amplifier AMP 41 has a first input which is electrically connected to node n1, a second input which is electrically connected to node n2, and an output which is electrically connected to an output node n0 of the circuit 40. A first resistor R1 is electrically connected between node n1 and node n0. A second resistor R2 is electrically connected between node n2 and node n0. The first and second resistors R1, R2 are stacked in first and second branches, respectively. Two Schottky diodes N5 and N12 are stacked with the second resistor R2 in series in the second branch. Schottky diode N5 is electrically connected between node n2 and node n21, and Schottky diode N12 is electrically connected between node n21 and ground.

In the first branch, between node n1 and ground, it has four sub-branches. In a first sub-branch, two Schottky diodes N1,N8 and a resistor R3 are stacked in series, wherein Schottky diode N1 is electrically connected between node n1 and node n3; Schottky diode N8 is electrically connected between node n3 and n4; and the resistor R3 is electrically connected between node n4 and ground. In a second sub-branch, two Schottky diodes N2,N9 and a resistor R4 are stacked in series, wherein Schottky diode N2 is electrically connected between node n1 and node n5; Schottky diode N9 is electrically connected between node n5 and n6; and the resistor R4 is electrically connected between node n6 and ground. In a third sub-branch, two Schottky diodes N3,N10 and a resistor R5 are stacked in series, wherein Schottky diode N3 is electrically connected between node n1 and node n7; Schottky diode N10 is electrically connected between node n7 and n8; and the resistor R5 is electrically connected between node n8 and ground. In a fourth sub-branch, two Schottky diodes N4,N11 and a resistor R6 are stacked in series, wherein Schottky diode N4 is electrically connected between node n1 and node n9; Schottky diode N11 is electrically connected between node n9 and n10; and the resistor R6 is electrically connected between node n10 and ground.

The amplifier 41 is a differential-input, single-ended-output amplifier with a gain of 10 or higher, and preferably 20 or higher, for greater accuracy. The loop containing the amplifier, R1, and R2 is balanced when the voltages at nodes n1 and n2 are equal, i.e. when resistors R1 and R2 are conducting equal currents. The amplifier 41 is able to adjust the voltage at node n0 until the currents flowing through the resistors R1,R2 are equal. The amplifier 41 can be a microchip circuit which is used to be integrated into the entire chip. It will be appreciated that the amplifier 41 can be any types of operational amplifiers with suitable gains, without departing from the principles of the present invention.

The Schottky diodes, N1–N4 and N8–N11, are electrically connected to the resistors R3–R6, respectively. Schottky diodes N1–N4 and N8–N11 operate at ¼ the current density of Schottky diodes N5 and N12. Accordingly, each of the diodes N1–N4 and N8–N11 has a smaller forward voltage drop, for example, about 36 mV smaller than the forward voltage drop of Schottky diode N5 or N12. Since the two diodes in each diode pair N1N8, N2N9, N3N10, or N4N11 are connected in series, the total difference in voltage drops is the sum of the two differences, for example, totally 72 mV. At a certain operating current, the voltage drop across resistors R3–R6 is also 72 mV, respectively. Accordingly, the resistors R3–R6 allow that the voltage at node n1 is equal to the voltage at node n2. It will be appreciated that other arrangements of the Schottky diodes can be used within the scope of the present invention. For example, two or three, or more than four sub-branches, e.g. ten sub-branches, can be used. In such cases, the value of the forward voltage drop may vary accordingly.

Figure 3:
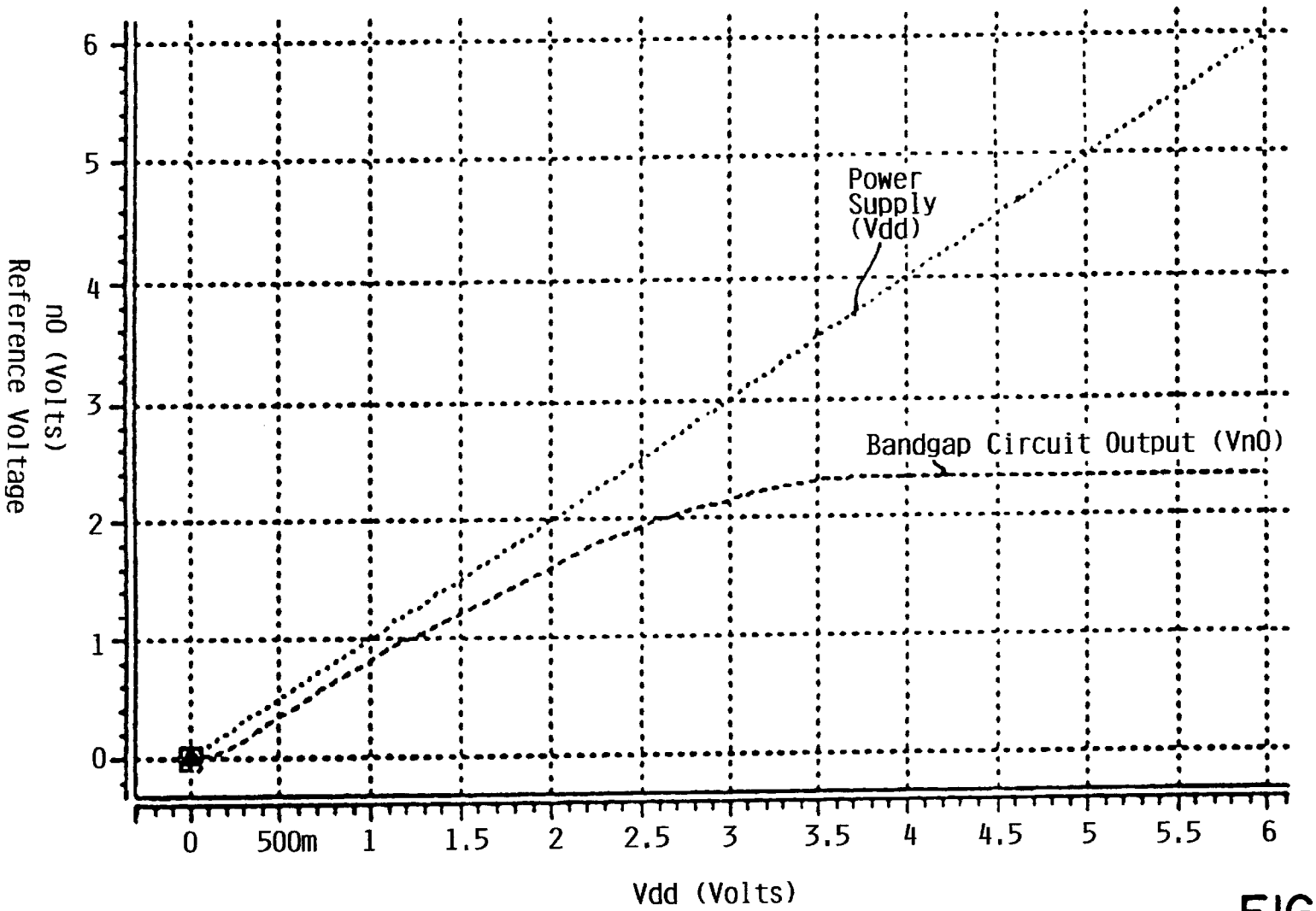
FIG. 3 is a plot of the input-output voltages of the bandgap circuit built from FET GaAs transistors shown in FIG. 2.

FIG. 3 shows an input-output voltage diagram of the exemplary bandgap circuit 40 illustrated in FIG. 2. In this case, the input voltage of the bandgap circuit is the power supply voltage of the amplifier, i.e. Vdd. The output voltage of the bandgap circuit is the voltage at the node n0. As Vdd increases, the output voltage at node n0 increases first and then remains approximately 2.328 volts. At that point on, the output voltage at node n0 is independent of the power supply voltage Vdd, for example, the power supply voltage over 4.0 volts, such as between 4.0 volts and 6.0 volts. Accordingly, the GaAs bandgap circuit of FIG. 2 is applicable for a power supply voltage around 5.0 volts, whereby a reference voltage about 2.3 volts can be obtained.

In the preferred embodiment, the values of R1 and R2 are selected to be about 10,000 ohms, and the values of R3, R4, R5, and R6 are selected to be about 1,000 ohms.

Figure 4:
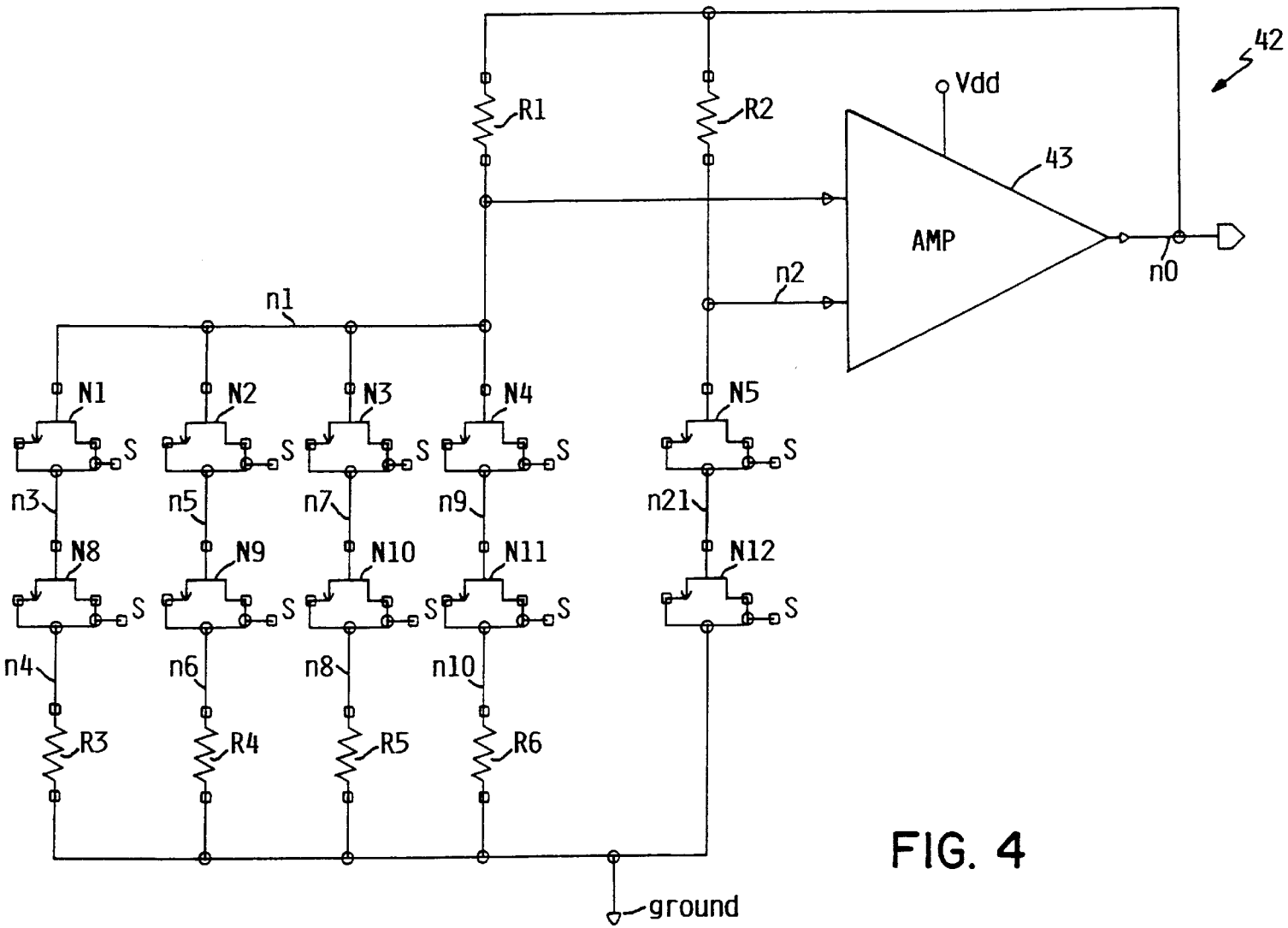
FIG. 4 is a circuit diagram of a second bandgap circuit built from FET GaAs transistors in accordance with the present invention.

FIG. 4 illustrates another bandgap circuit 42 which is applicable for a power supply voltage around 3.3 volts. An amplifier AMP 43 is a differential-input, single-ended-output amplifier with a gain of 10 or higher, and preferably 20 or higher, for greater accuracy. Similar to the amplifier in FIG. 2, in FIG. 4, the loop containing the amplifier 43, R1, and R2 is balanced when the voltages at nodes is n1 and n2 are equal, i.e. when resistors R1 and R2 are conducting equal currents. The amplifier 43 is able to adjust the voltage at node n0 until the currents flowing through the resistors R1,R2 are equal. The amplifier 43 can be a micro-chip circuit which is used to be integrated into the entire chip. It will be appreciated that the amplifier 43 can be any types of operational amplifiers with suitable gains, without departing from the principles of the present invention.

Figure 5:
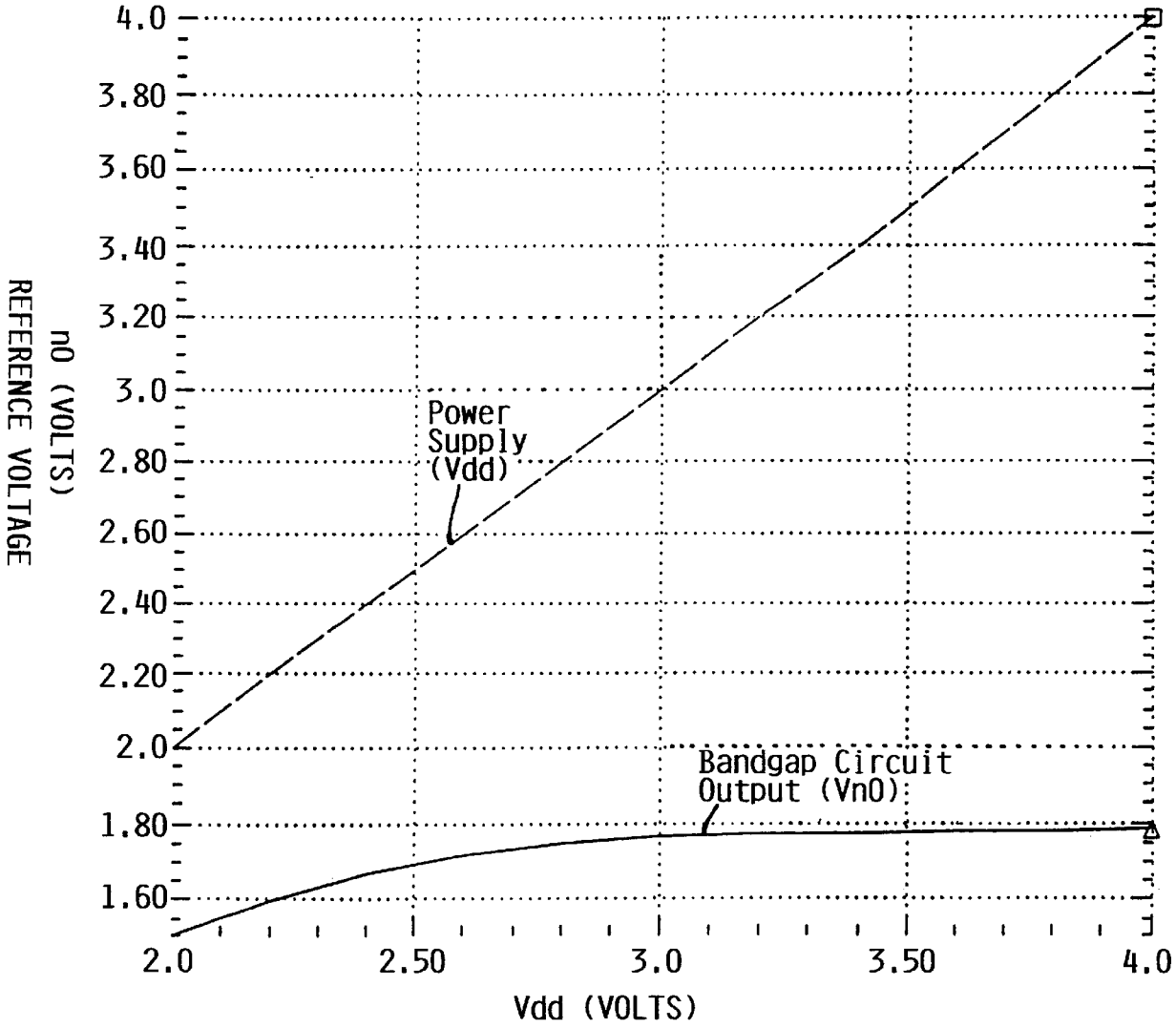
FIG. 5 is a plot of the input-output voltages of the second bandgap circuit built from FET GaAs transistors shown in FIG. 4.

FIG. 5 shows an input-output voltage diagram of the exemplary bandgap circuit 42 illustrated in FIG. 4. In this case, the input voltage of the bandgap circuit is the power supply voltage of the amplifier 43, i.e. Vdd. The output voltage of the bandgap circuit is the voltage at the node n0. As Vdd increases, the output voltage at node n0 increases first and then remains approximately 1.7858 volts. At this point on, the output voltage at node n0 is independent of the power supply voltage Vdd, for example, the power supply voltage over 3.1 volts, such as between 3.1 and 4.0 volts. Accordingly, the GaAs bandgap circuit of FIG. 4 is applicable for a power supply voltage around 3.3 volts, whereby a reference voltage about 1.8 volts can be obtained.

In the preferred embodiment shown in FIG. 4, the values of the resistors R1 and R2 are selected to be about 5,000 ohms, and the values of the resistors R3, R4, R5, and R6 are selected to be about 4,000 ohms. The arrangement of the Schottky diodes and the resistors in FIG. 4 are the same as those arranged in FIG. 2. It will be appreciated that other types of arrangements of the Schottky diodes and the resistors can be used in FIGS. 2 and 4 within the principles of the present invention. For example, the resistors in the sub-branches can be placed between node n1 and the first Schottky diode or between the first and second Schottky diodes. It will also be appreciated that more than one resistor can be used in each sub-branch.

Further, it will be appreciated that the numbers of Schottky diodes can be varied without departing from the principles of the invention. For example, in the second branch and the sub-branches, one Schottky diode is used. In this case, a lower power supply voltage is used, and a lower reference voltage, i.e. a reference voltage lower than 1.8 volts, can be obtained. Another example would be that in the second branch and the sub-branches, more than two Schottky diodes connected in series are used. In this case, a higher power supply voltage is used, and a higher reference voltage, i.e. a voltage higher than 2.3, can be obtained.

Furthermore, it will be appreciated that the other types of GaAs-based circuit elements can be used without departing from the principles of the present invention. For example, a GaAs-based circuit element which exhibits an exponential relation between a current flowing through the circuit element and a voltage across the circuit element can be used within the scope of the present invention.

The present invention has been described in its presently contemplated best mode, and it is clear that it is susceptible to various modifications, modes of operation and embodiments, all within the ability and skill of those skilled in the art and without the exercise of further inventive activity. Further, while the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. A gallium arsenide (GaAs) circuit having an input and a voltage output node, comprising:

a plurality of stacked GaAs transistors being connected as Schottky diodes which provide a constant reference voltage at the output of the circuit, the reference voltage being independent of the input of the circuit;

wherein the Schottky diodes are stacked in a first branch and a second branch, the first and second branches being electrically connected in parallel between the voltage output node and ground, respectively;

wherein, in the first branch, a first resistor is electrically connected between the voltage output node and a first node, in the second branch, a second resistor is electrically connected between the voltage output node and a second node;

wherein the circuit further includes an amplifier with a first input electrically connected to the first node, a second input electrically connected to the second node, and an output electrically connected to the voltage output node; and wherein the first branch includes a plurality of sub-branches, each of which includes the same number of Schottky diodes as in the second branch.

2. The circuit of claim 1, wherein the reference voltage is approximately 2.3 volts.

3. The circuit of claim 1, wherein the reference voltage is approximately 1.8 volts.

4. The circuit of claim 1, wherein the first branch includes four sub-branches, in each sub-branch, a first Schottky diode is electrically connected to the first node at one end and to a sub-first node at the other end, a second Schottky diode is electrically connected to the sub-first node at one end and to a sub-second node at the other end, and a third resistor is electrically connected to the sub-second node at one end and to the ground at the other end; and in the second branch, a first Schottky diode is electrically connected to the second node at one end and to a third node at the other end, and a second Schottky diode is electrically connected to the third node at one end and to the ground at the other end.

5. The circuit of claim 1, wherein a current in the each of the branches is the same.

6. The circuit of claim 4, wherein a current in the first branch and a current in the second branch are the same, and currents in each sub-branch are the same.

7. The circuit of claim 6, wherein the first and second resistors have the same resistance, the Schottky diodes of each branch and sub-branch are the same, and the resistors of each sub-branch have the same resistance.

8. The circuit of claim 1, wherein a gain of the amplifier is at least 20.

9. The circuit of claim 1, wherein the first branch includes four sub-branches, in each sub-branch, a Schottky diode is electrically connected to the first node at one end and to a sub-first node at the other end, and a third resistor is electrically connected to the sub-first node at one end and to the ground at the other end; and in the second branch, a Schottky diode is electrically connected to the second node at one end and to the ground at the other end.

10. The circuit of claim 9, wherein a current in the first branch and a current in the second branch are the same, and currents in each sub-branch are the same.

11. The circuit of claim 10, wherein the first and second resistors have the same resistance, the Schottky diode of each branch and sub-branch is the same, and the resistor of each sub-branch has the same resistance.

12. A gallium arsenide (GaAs) circuit having an input and a voltage output node, comprising:

a plurality of stacked GaAs transistors being connected as Schottky diodes, the Schottky diodes being stacked in a first branch and a second branch, wherein the first and second branches are electrically connected in parallel between the voltage output node and ground, respectively;

an amplifier having a first input electrically connected to the first branch, a second input electrically connected to the second branch, and an output electrically connected to both first and second branches, wherein the input of the circuit is a power supply of the amplifier, and the output of the circuit is the output of the amplifier; and means for providing a same electrical current in the first branch and the second branch and for providing a constant reference voltage at the output of the circuit, such that the reference voltage is independent of the input of the circuit, wherein the means for providing the same electrical current in the first branch and the second branch and for providing the constant reference voltage at the output of the circuit includes;

in the first branch, a first resistor is electrically connected between the voltage output node and a first node, and in the second branch, a second resistor is electrically connected between the voltage output node and a second node;

the first input of the amplifier electrically connected to the first node, the second input of the amplifier electrically connected to the second node, and the output of the amplifier electrically connected to the voltage output node; and the first branch includes a plurality of sub-branches, each of which includes the same number of Schottky diodes as in the second branch.

13. The circuit of claim 12, wherein the reference voltage is approximately 2.3 volts.

14. The circuit of claim 12, wherein the reference voltage is approximately 1.8 volts.

15. The circuit of claim 12, wherein the first branch includes four sub-branches, in each sub-branch, a first Schottky diode is electrically connected to the first node at one end and to a sub-first node at the other end, a second Schottky diode is electrically connected to the sub-first node at one end and to a sub-second node at the other end, and a third resistor is electrically connected to the sub-second node at one end and to the ground at the other end; and in the second branch, a first Schottky diode is electrically connected to the second node at one end and to a third node at the other end, and a second Schottky diode is electrically connected to the third node at one end and to the ground at the other end.

16. The circuit of claim 12, wherein the first and second resistors have the same resistance, the Schottky diodes of each branch and sub-branch are the same, and the resistors of each sub-branch have the same resistance.

17. The circuit of claim 12, wherein a gain of the amplifier is at least 20.

18. The circuit of claim 12, wherein the first branch includes four sub-branches, in each sub-branch, a Schottky diode is electrically connected to the first node at one end and to a sub-first node at the other end, and a third resistor is electrically connected to the sub-first node at one end and to the ground at the other end; and in the second branch, a Schottky diode is electrically connected to the second node at one end and to the ground at the other end.

19. The circuit of claim 18, wherein the first and second resistors have the same resistance, the Schottky diode of each branch and sub-branch is the same, and the resistor of each sub-branch has the same resistance.

20. A gallium arsenide (GaAs) voltage reference circuit having an output node, comprising:

an amplifier having a first input and a second input, and an output electrically connected to said output node;

a first branch connected between said output node and ground and providing said first input to said amplifier, said first branch including a plurality of parallel sub-branches, each sub-branch containing N GaAs field-effect transistors (FETs) of a first configuration, N>1, wherein each GaAs FET of a first configuration is configured with its respective source and drain electrically coupled together to form a first terminal of the GaAs FET of a first configuration and the gate forming a second terminal of the GaAs FET of a first configuration;

a second branch connected between said output node and ground in parallel with said first branch and providing said second input to said amplifier, said second branch containing N GaAs FET of said first configuration.

21. The gallium arsenide voltage reference circuit of claim 20, wherein in said first branch, a first resistor is electrically connected between said voltage output node and a first node, said first node being the first input to said amplifier; and in said second branch, a second resistor is electrically connected between said voltage output node and a second node, said second node being the second input to said amplifier.

22. The gallium arsenide voltage reference circuit of claim 20, wherein N>2, the GaAs FETs of a first configuration within each respective sub-branch of said first branch and within said second branch being stacked.

23. The gallium arsenide voltage reference circuit of claim 20, wherein each sub-branch of said first branch includes a respective resistor in series with said N GaAs FETs of a first configuration.

* * * * *

UNITED STATES PATENT AND TRADEMARK OFFICE

CERTIFICATE OF CORRECTION

PATENT NO. : 6,184,743 B1
DATED : February 6, 2001
INVENTOR(S) : David Peter Swart It is certified that error appears in the above-identified patent and that said Letters Patent is hereby corrected as shown below:

Column 8, claim 20,
Line 38, "N>1" should be -- N $\geq$1 --.

Column 8, claim 22,
Line 59, "N>2" should be -- N $\geq$2 --.

Signed and Sealed this

Twenty-fifth Day of December, 2001

*Attest:*

*Attesting Officer*

JAMES E. ROGAN
*Director of the United States Patent and Trademark Office*